US007487093B2

(12) United States Patent
Mutsuno et al.

(10) Patent No.: US 7,487,093 B2
(45) Date of Patent: Feb. 3, 2009

(54) TEXT STRUCTURE FOR VOICE SYNTHESIS, VOICE SYNTHESIS METHOD, VOICE SYNTHESIS APPARATUS, AND COMPUTER PROGRAM THEREOF

(75) Inventors: Masahiro Mutsuno, Kanagawa (JP); Toshiaki Fukada, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 403 days.

(21) Appl. No.: 10/914,169

(22) Filed: Aug. 10, 2004

(65) Prior Publication Data

US 2005/0065795 A1 Mar. 24, 2005

Related U.S. Application Data

(63) Continuation of application No. PCT/JP03/04231, filed on Apr. 2, 2003.

(30) Foreign Application Priority Data

Apr. 2, 2002 (JP) ..... 2002-100467

(51) Int. Cl.
*G10L 13/00* (2006.01)
*G10L 13/06* (2006.01)

(52) U.S. Cl. ..... 704/266; 704/258

(58) Field of Classification Search ..... 704/266, 704/258

See application file for complete search history.

(56) References Cited

U.S. PATENT DOCUMENTS 5,745,650 A 4/1998 Otsuka et al.
5,745,651 A 4/1998 Otsuka et al.
5,845,047 A 12/1998 Fukada et al.
5,983,184 A 11/1999 Noguchi
6,226,614 B1 5/2001 Mizuno et al.
6,334,106 B1 12/2001 Mizuno et al.
6,778,960 B2 8/2004 Fukada
2001/0032078 A1 10/2001 Fukada
2002/0026315 A1 2/2002 Miranda
2002/0049590 A1 4/2002 Yoshino et al.
2002/0051955 A1 5/2002 Okutani et al.
2003/0158735 A1 8/2003 Yamada et al.
2003/0229496 A1 12/2003 Yamada et al.

FOREIGN PATENT DOCUMENTS

EP 0 880 127 11/1998
EP 1 160 764 12/2001

(Continued)

OTHER PUBLICATIONS

Note: English-language counterpart document(s) also cited (see text of IDS).

(Continued)

*Primary Examiner*—David R Hudspeth
*Assistant Examiner*—Justin W Rider
(74) *Attorney, Agent, or Firm*—Fitzpatrick, Cella, Harper & Scinto

(57) ABSTRACT

In a voice synthesis apparatus, by bounding a desired range of input text to be output by, e.g., a start tag "<morphing type="emotion" start="happy" end="angry">" and end tag </morphing>, a feature of synthetic voice is continuously changed while gradually changing voice from a happy voice to an angry voice upon outputting synthetic voice.

4 Claims, 14 Drawing Sheets

FOREIGN PATENT DOCUMENTS

| | | |
|---|---|---|
| JP | 63-253996 | 10/1988 |
| JP | 6-236197 | 8/1994 |
| JP | 7-191695 | 7/1995 |
| JP | 9-152892 | 6/1997 |
| JP | 9-160582 | 6/1997 |
| JP | 9-244693 | 9/1997 |
| JP | 10-78952 | 3/1998 |
| JP | 11-202884 | 7/1999 |
| JP | 2002-23775 | 1/2002 |

OTHER PUBLICATIONS

Japanese Office Action dated Feb. 9, 2007, issued in corresponding Japanese patent application No. 2002-100467, with partial English-language translation.

Office Action dated Jun. 15, 2007, issued in Japanese patent application No. 2002-100467, with English-language translation.

Masanobu Abe, "Speech Morphing by Gradually Changing Spectrum Parameter and Fundamental Frequency," Institute of Electronics, Information and Communication Engineers Technical Report of IEICE (Jul. 1996), pp. 25-32, with English-language translation.

FIG. 2

```
<morphing type="emotion" start="happy" end="angry">SNOW DUE TO WINTRY PRESSURE PATTERN DISRUPTED
TRANSPORTATION SYSTEMS IN WESTERN JAPAN SUCH AS KINKI DISTRICT ON 9TH</morphing>
```

FIG. 7

```
<morphing type="emotion" start="happy" end="angry"> <morphing type="volume" start="10" end="5">SNOW DUE TO
WINTRY PRESSURE PATTERN DISRUPTED TRANSPORTATION SYSTEMS IN WESTERN JAPAN SUCH AS KINKI DISTRICT
ON 9TH</morphing> </morphing>
```

FIG. 8

<morphing=emotion start="happy" emotion end="angry">SNOW DUE TO WINTRY PRESSURE PATTERN DISRUPTED TRANSPORTATION SYSTEMS IN WESTERN JAPAN SUCH AS KINKI DISTRICT ON 9TH</morphing>

FIG. 10

```
<morphing type="emotion" start="happy" end="angry" function="liner">SNOW DUE TO WINTRY PRESSURE PATTERN
DISRUPTED TRANSPORTATION SYSTEMS IN WESTERN JAPAN SUCH AS KINKI DISTRICT ON 9TH</morphing>
```

FIG. 11

```
<morphing type="emotion" start="happy" end="angry">SNOW DUE TO WINTRY PRESSURE PATTERN<rate value="0.2"/>
DISRUPTED TRANSPORTATION SYSTEMS<rete value="0.5"/>
IN WESTERN JAPAN SUCH AS KINKI DISTRICT<rete value="0.8"/> ON 9TH</morphing>
```

FIG. 13

```
<morphing type="emotion" start="happy" >SNOW DUE TO WINTRY PRESSURE PATTERN DISRUPTED TRANSPORTATION
SYSTEMS IN WESTERN JAPAN SUCH AS KINKI DISTRICT ON 9TH</morphing end="angriy">
```

TEXT STRUCTURE FOR VOICE SYNTHESIS, VOICE SYNTHESIS METHOD, VOICE SYNTHESIS APPARATUS, AND COMPUTER PROGRAM THEREOF

TECHNICAL FIELD

The present invention relates to the field of a voice synthesis apparatus which outputs an input sentence (text) as synthetic voice from a loudspeaker.

BACKGROUND ART

Conventionally, a voice synthesis apparatus which outputs an input sentence (text) as synthetic voice (synthetic sound, synthetic speech) from a loudspeaker has been proposed.

In order to generate richly expressive synthetic voice from text using such apparatus, control information of a strength, speed, pitch, and the like must be given, so that the user as a listener can listen to it as natural voice.

For this purpose, even when synthetic voice is output on the basis of a predetermined rule contained in a character string of text, an attempt is made to add desired language information into that text.

In this case, additional information given to the text uses a format that bounds additional information by tags expressed by "< >" like those used in so-called HTML (Hyper Text Markup Language), and a method of controlling synthetic voice tones corresponding to input text using these tags has been proposed.

However, in such conventional tagging method, since tagging is made for respective discrete units such as sentences, words, and the like to set a predetermined fixed value, synthetic voice to be actually output undergoes only discrete changes although that method aims at outputting synthetic voice corresponding to various characters and words in input text while continuously changing an appropriate prosody, resulting in unnatural synthetic voice for a listener.

As a technique for continuously changing a certain prosody of voice, a voice morphing method is proposed by Japanese Patent Laid-Open No. 9-244693. However, with this method, only the pitch pattern can be interpolated.

Furthermore, with these methods, when synthetic voice of a portion bounded by tags in input text is to be continuously changed, tags must be adequately assigned to change points of the synthetic voice. Hence, the tagging operation is troublesome, and only a discrete change can be consequently obtained.

DISCLOSURE OF INVENTION

The present invention has been proposed to solve the conventional problems, and has as its object to continuously and easily change a feature of synthetic voice of a desired range.

In order to achieve the above object, a voice synthesis method according to the present invention is characterized by the following arrangement.

That is, there is provided a voice synthesis method for synthesizing a voice waveform to continuously change a feature of synthetic voice of a range assigned a predetermined identifier included in input text upon outputting synthetic voice corresponding to the text, comprising:

a setting step of setting a desired range of text to be output, in which the feature of synthetic voice is to be continuously changed, using a predetermined identifier including attribute information that represents a change mode of the feature of synthetic voice; a recognition step of recognizing the predetermined identifier and a type of attribute information contained in the predetermined identifier from the text with the identifier, which is set in the setting step; and a voice synthesis step of synthesizing a voice waveform, whose feature of synthetic voice continuously changes, in accordance with the attribute information contained in the predetermined identifier, by interpolating synthetic voice corresponding to text within the desired range of the text with the identifier in accordance with a recognition result in the recognition step.

In a preferred embodiment, the attribute information contained in the predetermined identifier represents a change mode of the feature of synthetic voice at a start position of the range set by the identifier, and a change mode of the feature of synthetic voice at an end position.

For example, the change mode of the feature of synthetic voice represented by the attribute information is at least one of a change in volume, a change in speaker, a change in output device, a change in number of speakers, a change in emotion, a change in uttering speed, and a change in fundamental frequency.

For example, the voice synthesis step includes a step of: generating synthetic voice corresponding to the text within the desired range on the basis of attribute information associated with start and end positions of the range set by identifiers contained in the predetermined identifier, and a mode of the feature of synthetic voice before the start position.

More specifically, the voice synthesis step preferably comprises a step of:

generating synthetic voice corresponding to the text within the desired range on the basis of a ratio between values that represent uttering speeds set as the attribute information associated with the start and end positions, and a value that represents an uttering speed before the start position, or generating synthetic voice corresponding to the text within the desired range on the basis of a ratio between values that represent volumes set as the attribute information associated with the start and end positions, and a value that represents a volume before the start position.

Alternatively, in order to achieve the above object, there is provided a text structure for voice synthesis, in which a predetermined identifier is assigned to change a feature of synthetic voice of a desired range of text to be output by voice synthesis, wherein the predetermined identifier contains attribute information that represents a change mode upon continuously changing the feature of synthetic voice.

Note that the above object is also achieved by a voice synthesis apparatus corresponding to the voice synthesis method with the above arrangements.

Also, the above object is also achieved by a program code which makes a computer implement the voice synthesis method or apparatus with the above arrangements, and a computer readable storage medium that stores the program code.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 2 shows an example of tags assigned to text;

FIG. 7 shows an example of tags assigned to text in the second embodiment;

FIG. 8 shows an example of tags assigned to text in the third embodiment;

FIG. 10 shows an example of tags assigned to text in the fourth embodiment;

FIG. 11 shows an example of tags assigned to text in the fifth embodiment;

FIG. 13 shows an example of tags assigned to text in the sixth embodiment.

BEST MODE OF CARRYING OUT THE INVENTION

Preferred embodiments of the present invention will now be described in detail in accordance with the accompanying drawings.

First Embodiment

Figure 1:
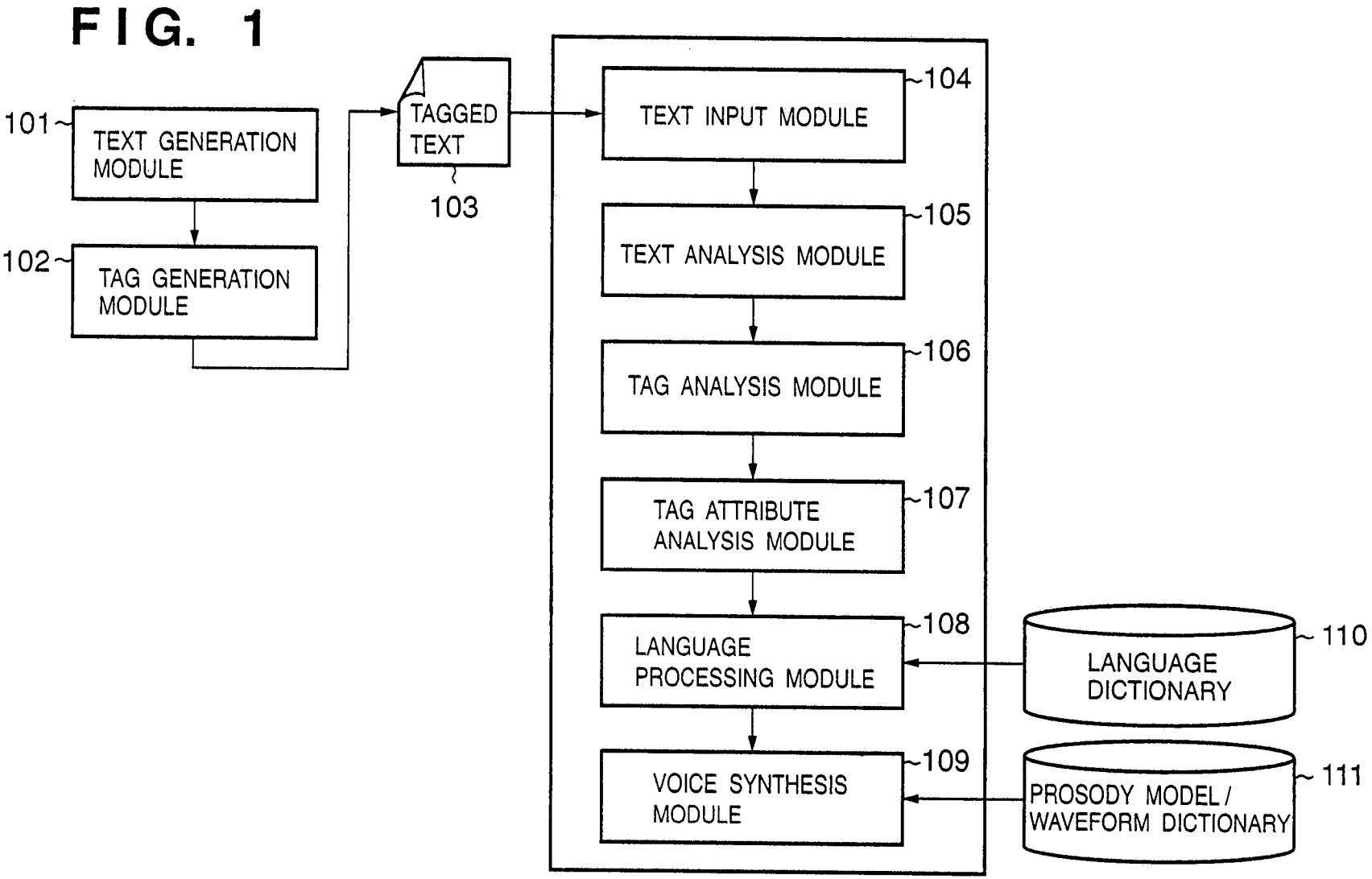
FIG. 1 is a block diagram of a voice synthesis apparatus according to the first embodiment.

The arrangement of a voice synthesis apparatus according to this embodiment will be briefly explained first with reference to FIG. 1.

FIG. 1 is a block diagram of a voice synthesis apparatus of the first embodiment. As hardware that can be adopted, a general information processing apparatus such as a personal computer or the like can be adopted.

Referring to FIG. 1, the apparatus comprises a text generation module 101 for generating a text body, and a tag generation module 102 for generating tagged text 103 by inserting predetermined tags at desired positions in that text, and also attributes in these tags, in association with generation of tagged text to be output as voice. The text generation module 101 generates text on the basis of various information sources such as mail messages, news articles, magazines, printed books, and the like. In this case, editor software used to write tags and text is not particularly limited.

Note that a module indicates a functional unit of a software program executed by hardware of the voice synthesis apparatus according to this embodiment.

Note that the text generation module 101 and tag generation module 102 can be either external modules or internal modules of the voice synthesis apparatus itself.

The tagged text 103 is input to a text input module 104 via a communication line or a portable storage medium (CD-R or the like). A text part of the tagged text 103 input to the text input module 104 is analyzed by a text analysis module 105, and its tag part is analyzed by a tag analysis module 106. Furthermore, in this embodiment, attribute information contained in a tag is analyzed by a tag attribute analysis module 107 (details will be explained later).

A language processing module 108 processes language information (e.g., accent and the like) required upon outputting voice with reference to a language dictionary 110 that pre-stores language information. A voice synthesis module 109 generates a synthetic waveform that expresses voice to be actually output with reference to a prosody model/waveform dictionary 111 that pre-stores prosodic phonemes and the like, and outputs synthetic voice from a loudspeaker (not shown) on the basis of that synthetic waveform.

Arrangements as a characteristic feature of this embodiment will be explained below.

The tag generation module 102 inserts predetermined tags and attributes into text generated by the text generation module 101. In this case, tags can be inserted at positions of user's choice, and can be assigned to a portion where a feature of synthetic voice is to be smoothly changed like in so-called morphing in an image process. In each tag, additional information called an attribute (attribute information) can be written. More specifically, predetermined tags "<morphing . . . >" and "</morphing>" are assigned to the start and end points of a portion where a feature of synthetic voice is to be smoothly changed of text in which characters and words line up, and attribute information that represents an object whose feature of synthetic voice is to be continuously changed, in other words, a change pattern upon continuously changing the feature of synthetic voice, is written in each tag.

In this embodiment, the changing of the feature of synthetic voice includes not only so-called prosody of voice but also e.g., speaker, the number of speakers, emotion, and the like.

Note that the user writes the attribute information upon generation of text. Also, the user sets tags and various attributes in the tags. Note that the tags and attribute values may be automatically or semi-automatically set by a multi-function editor or the like.

Attribute information embedded in each tag is information, which is representing the feature of synthetic voice, associated with, e.g., a volume, speaker, output device, the number of speakers, emotion, uttering speed, fundamental frequency, and the like. In addition, other events which can be continuously changed upon outputting synthetic voice (to be referred to as "morphing" in this embodiment) may be used.

Start and end point tags set in text may have the same or different kinds of attribute information. When the start and end points have the same attribute information, voice according to the attribute information set by the start point tag is output without changing any feature of synthetic voice in association with that attribute information upon actually outputting synthetic voice.

A value corresponding to attribute information embedded in each tag is a numerical value if an attribute is a volume. If an attribute is a speaker, a male or female, or an identification number (ID) of the speaker can be designated.

FIG. 2 shows an example of tags assigned to text. In this example, a range where a feature of synthetic voice is to be continuously changed corresponds to a range bounded by a start tag "<morphing . . . >" and end tag "</morphing>". Attributes in the start tag "<morphing . . . >" describe an emotion (emotion) as an object whose feature of synthetic voice is to be continuously changed, an emotion (happy) at the start point (start), and an emotion (angry) at the end point (end). Hence, when synthetic voice of this text is actually output, a sentence bounded by the tags is uttered while its voice gradually changes from a happy voice to an angry voice.

The text input module 104 of the voice synthesis apparatus according to this embodiment receives the tagged text 103 assigned with tags, as described above, and the text analysis module 105 acquires information associated with the type, contents, and the like of text on the basis of the format of the input tagged text 103 and information in the header field of text.

The tag analysis module 106 determines the types of tags embedded in the input tagged text 103. The tag attribute analysis module 107 analyzes attributes and attribute values described in the tags.

The language processing module 108 and voice synthesis module 109 generate a voice waveform to be output by processing data, which is read out from the prosody model/waveform dictionary 111, as phonemes corresponding to the text analyzed by the text analysis module 105 on the basis of the attribute values acquired by the tag attribute analysis module 107, and output synthetic voice according to that voice waveform (note that the processing based on the attribute values will be explained later).

A method of extracting attribute values in "<morphing> . . . </morphing>" tags by the tag analysis module 106 will be explained below using FIGS. 3A and 3B.

Figure 3A:
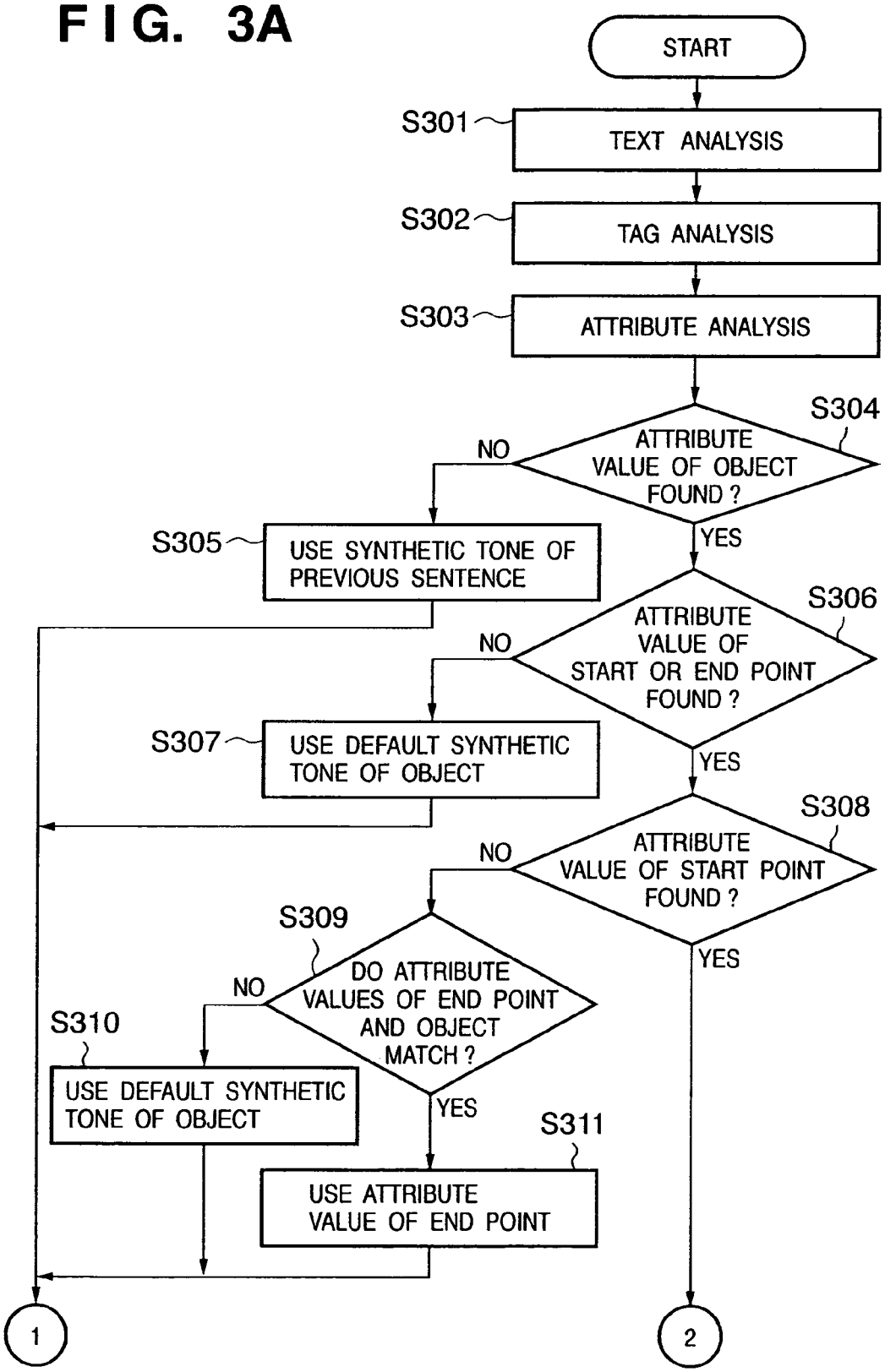
FIGS. 3A and 3B are flow charts showing the control process of the voice synthesis apparatus of the first embodiment.
Figure 3B:
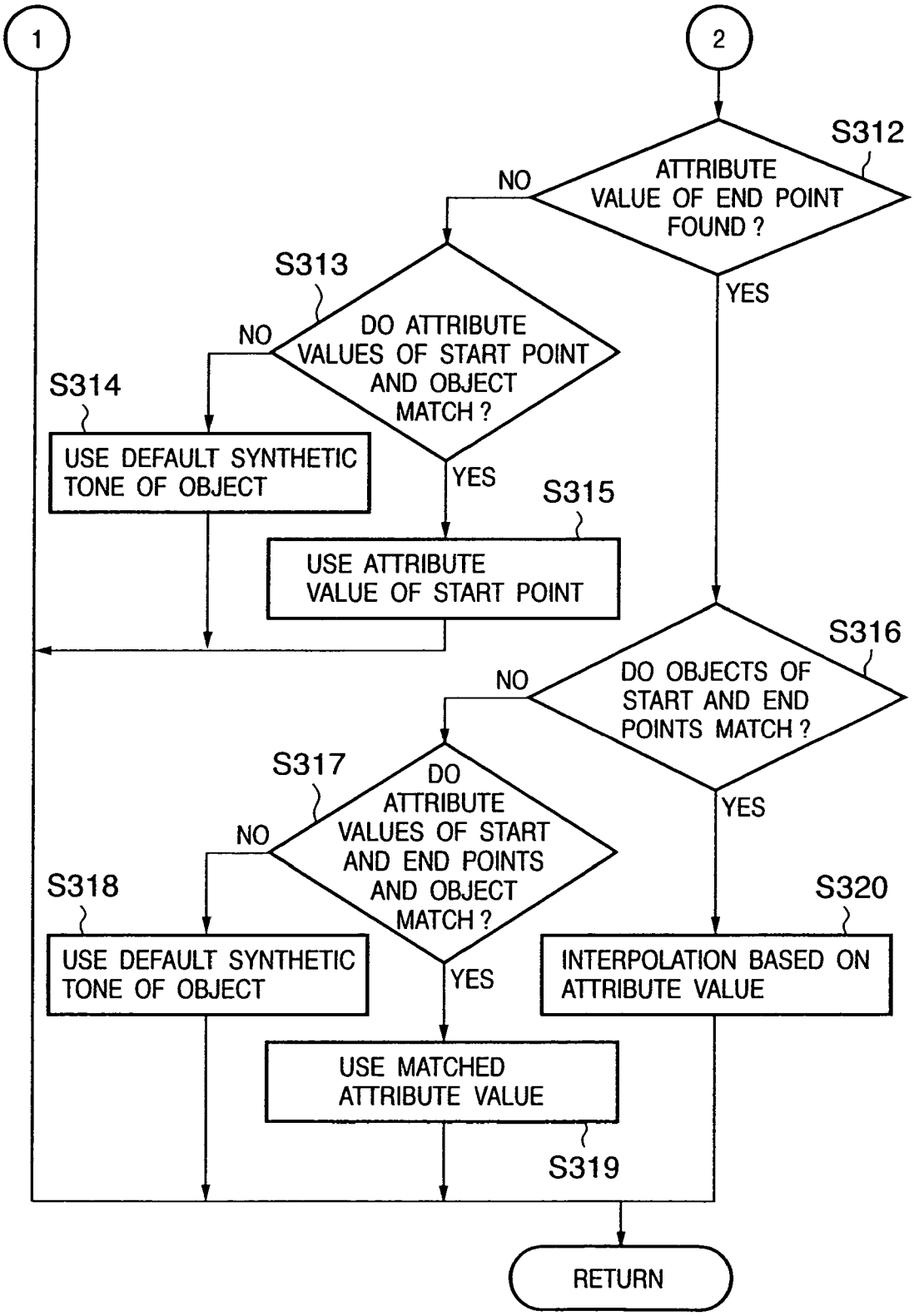

FIGS. 3A and 3B are flow charts showing the control process of the voice synthesis apparatus of the first embodiment, i.e., the sequence of processes to be executed by a CPU (not shown) of the apparatus.

Referring to FIGS. 3A and 3B, the tagged text 103 input by the text input module 104 undergoes text analysis, tag analysis, and tag attribute analysis by the text analysis module 105, tag analysis module 106, and tag attribute analysis 107 (steps S301 to S303).

It is checked if the start tag "<morphing . . . >" includes objects and start and end points (step S304). It is checked first if an attribute value to be morphed is included. If no attribute value to be morphed is found, characters and words bounded by the start and end tags are read aloud in accordance with voice that has been read aloud in a sentence before that tag (step S305). On the other hand, if an attribute value to be morphed is found, it is checked if either one of attributes of start and end points is found (step S306).

If neither of the start and end points have attributes, characters and words bounded by the start and end tags are read aloud using a synthetic tone according to a default attribute value to be morphed, which is set in advance (step S307). On the other hand, if either the start or end point has an attribute value, it is checked if it is an attribute value of the start point (step S308). If it is not an attribute value of the start point, whether or not the attribute value of the end point and attribute value to be morphed are valid (they match) is determined by checking if these values match (step S309). If the two values match, the attribute value of the end point is used (step S311). In step S309, for example, if an object to be morphed is a volume, it is checked if the attribute value of the end point is a volume value, and if they match, characters and words bounded by the start and end tags are read aloud based on information of the end point; if they do not match, characters and words bounded by the start and end tags are read aloud using a default synthetic tone which is prepared in advance in correspondence with the attribute value of the object (step S310).

If it is determined in step S308 that the start point has an attribute value, and if the end point does not have an attribute value, text is read aloud according to the attribute value of the start point (step S312, step S315). In this case, the validity with an object is similarly checked, and if the two values match, text is read aloud according to the attribute value of the start point (step S313, step S314).

If both the start and end points have attribute values, and their values for the object are valid (match), a synthetic tone is output after interpolation based on the attribute values (step S316, S320). That is, if the object is a volume, it is determined that the attribute values of the start and end points are valid only when both the start and end points assume volume values. For example, if the attribute values of the start and end points are different (e.g., the start point is a volume value and the end point is an emotion), the attribute value which matches the object is used (step S317, step S319). If the attribute values of the start and end points are different and are also different from the object to be morphed, characters and words bounded by the start and end tags are read aloud using a default synthetic tone corresponding to the attribute value of the object (step S318). When tags to be checked have different attribute values, the priority of a voice output is "object">"start point">"end point".

Interpolation which is made based on an attribute value as a sequence of voice generation will be described below with reference to FIG. 4.

Figure 4:
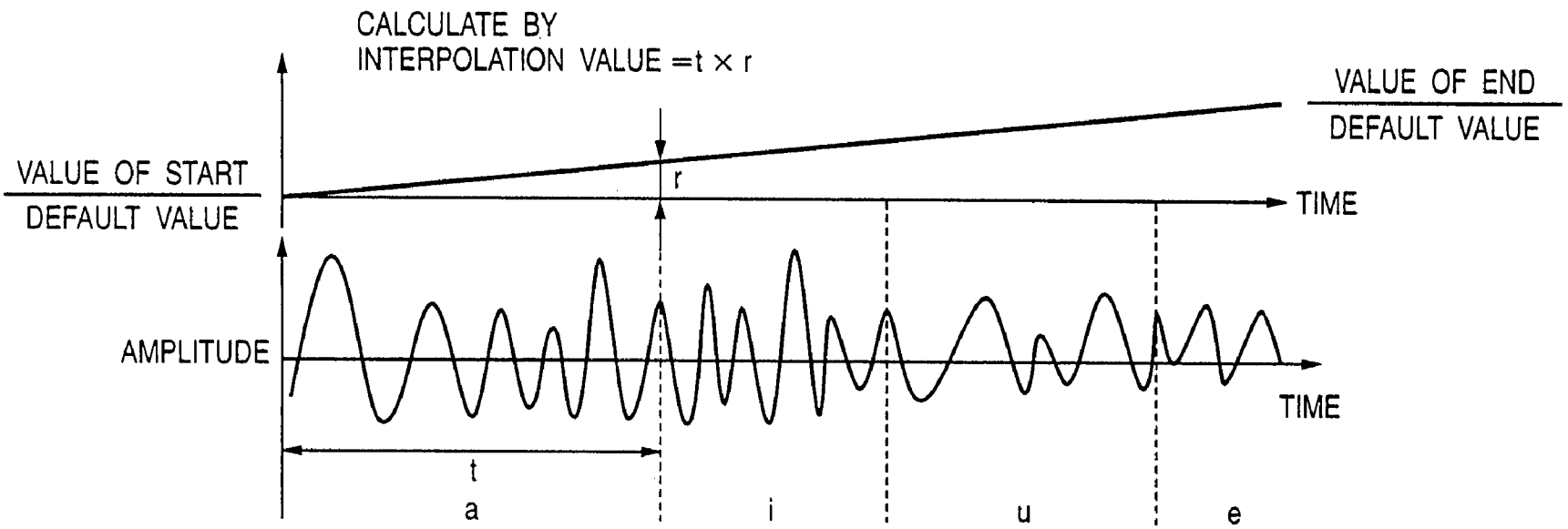
FIG. 4 is a graph for explaining an example of interpolation of an uttering speed upon outputting synthetic voice.

FIG. 4 is a graph for explaining an example of interpolation of an uttering speed upon outputting synthetic voice.

As an example of an interpolation method, when the uttering speed is to be interpolated, the time required to output the waveform of full text (あ(a), い(i), う(u), え(e) in FIG. 4) is calculated in accordance with that text to be output, and time durations t for respective phonemes which form that text are also calculated. In this embodiment, since standard prosodic models and voice waveforms are registered in advance in the prosody model/waveform dictionary 111, the time required to output the waveform of full text to be output can be calculated by summing up time durations t for respective phonemes (あ(a), い(i), う(u), え(e) in FIG. 4) required to output synthetic voice read out from the prosody model/waveform dictionary 111.

Then, ratio r between the values set as the attribute values of the start and end points, and the current uttering speed is calculated. In this case, if values set as the attribute values of the start and end points are equal to the current speed, since r=1, this interpolation process is not required.

Based on the calculated ratio, an interpolation function of each phoneme is calculated by (interpolation value)=t×r. By reducing or extending the period of a waveform in accordance with the calculated interpolation value, the uttering speed can be changed. Alternatively, a process for changing the time duration in correspondence with a certain feature of each phoneme may be made.

Figure 5:
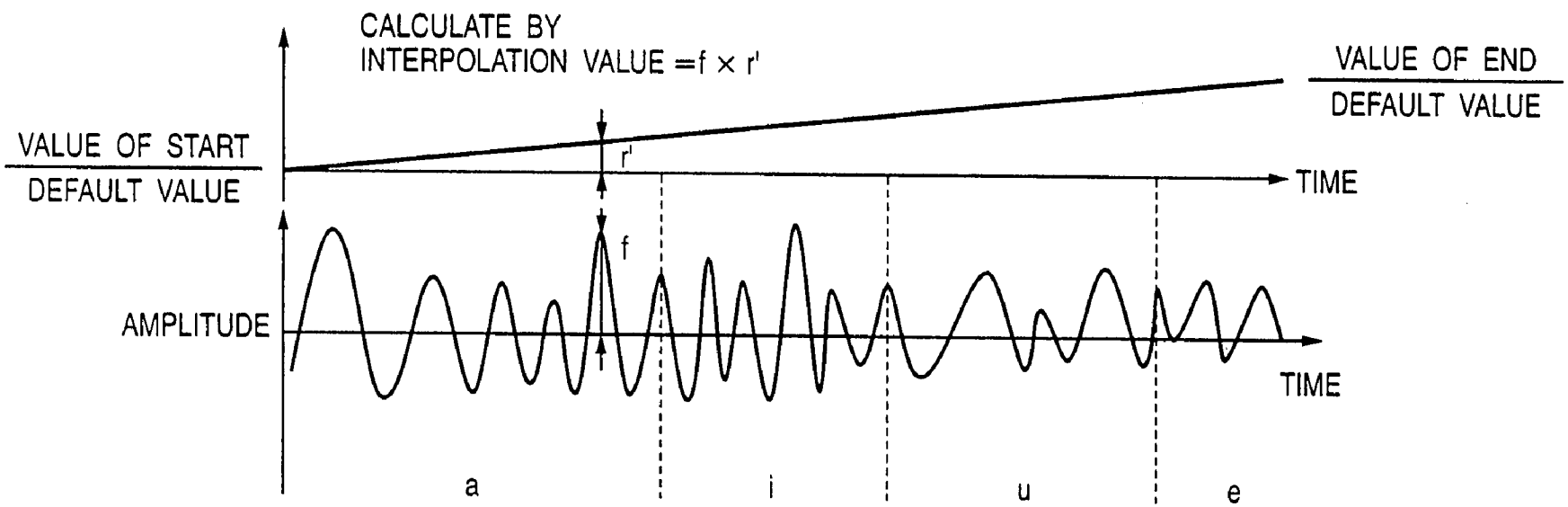
FIG. 5 is a graph for explaining an example of interpolation of a volume upon outputting synthetic voice.

Upon interpolation of a volume, time durations t of respective phonemes which form text to be output (あ(a), い(i), う(u), え(e) in FIG. 5) are used in accordance with that text as in interpolation of the uttering speed. Then, ratio r' between values set as the attribute values of the start and end points and the current volume is calculated.

FIG. 5 is a graph for explaining interpolation of a volume upon outputting synthetic voice. In FIG. 5, an interpolation function is calculated by (interpolation value)=f×r'. Note that f is the amplitude of a synthetic voice waveform obtained from the phoneme/waveform dictionary 111.

Amplitude f is reduced or extended in accordance with the calculated interpolation value. In place of changing the amplitude, a method of directly changing the volume of output hardware may be adopted. The same method applies to the fundamental frequency.

Furthermore, upon interpolating an emotion or uttering style, voice synthesis data corresponding to values set as the attribute values of the start and end points of text to be output are interpolated, thereby generating synthetic voice.

For example, in a voice synthesis method based on a waveform edit method such as PSOLA or the like, a voice segment in a voice waveform dictionary corresponding to an emotion set at the start position in text to be output, and that in the voice waveform dictionary corresponding to an emotion set at the end position undergo a PSOLA process with respect to a desired continuation time duration and fundamental frequency, and the voice waveform segments or synthetic voice waveform are interpolated in accordance with an interpolation function obtained in the same manner as in a volume.

In addition, in a voice synthesis method based on a parameter analysis synthesis method such as cepstrum or the like, a parameter sequence obtained from a voice parameter dictionary corresponding to an emotion set at the start position in text to be output, and that obtained from the voice parameter dictionary corresponding to an emotion set at the end position are interpolated to generate a parameter, and synthetic voice corresponding to a desired continuation time duration and fundamental frequency is generated using this parameter.

Furthermore, like in a change from a male voice to a female voice, interpolation between speakers can be made by similar methods. Moreover, when an output device comprises stereophonic loudspeakers, an output may be continuously changed from a left loudspeaker to a right loudspeaker. Or when an output device comprises a headphone and external loudspeaker, an output may be continuously changed from the head phone to the external loudspeaker.

Figure 6:
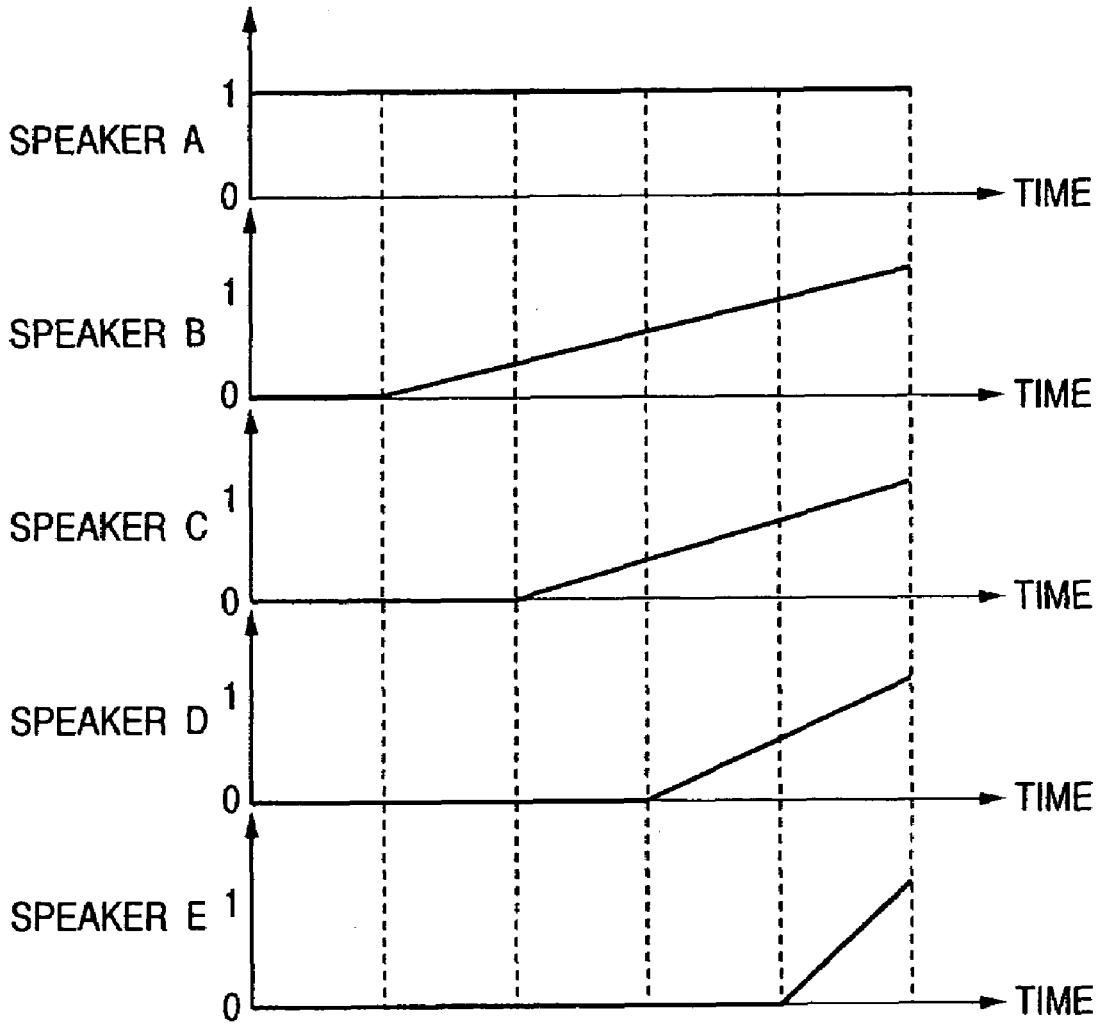
FIG. 6 is a graph for explaining an example of interpolation of the number of speakers upon outputting synthetic voice.

Upon interpolation of the number of speakers (the number of persons who speak), an interpolation function shown in FIG. 6 is calculated.

FIG. 6 is a graph for explaining an example of interpolation of the number of speakers upon outputting synthetic voice. In the example shown in FIG. 6, morphing from one speaker to five speakers is implemented. In this case, the time duration of a waveform obtained from text to be output is divided into five periods. Every time a divided period elapses, the number of speakers is increased one by one, and the volume of the synthetic tone is changed on the basis of an interpolation function (a function that changes between 0 and 1) shown in FIG. 6. Also, the waveform level is normalized to prevent the amplitude from exceeding a predetermined value.

Note that speakers may be added in a predetermined order or randomly.

In this embodiment, synthetic voice is output in accordance with a voice waveform generated by executing the aforementioned various interpolation processes. In this manner, natural synthetic voice, whose feature of synthetic voice changes continuously, can be implemented compared to a conventional voice synthesis apparatus with which a feature of synthetic voice changes discretely.

Second Embodiment

The second embodiment based on the voice synthesis apparatus according to the first embodiment mentioned above will be explained below. In the following description, a repetitive description of the same building components as those in the first embodiment will be omitted, and a characteristic feature of this embodiment will be mainly explained.

In this embodiment, predetermined tags contained in tagged text 103 adopts a nested structure of tags, as shown in FIG. 7, in addition to the two tags "<morphing . . . >" and "</morphing>" as in the first embodiment, thereby setting a plurality of objects to be changed. With this nested structure, voice synthesis morphing that can change a plurality of objects can be implemented. That is, in the example shown in FIG. 7, a feature of synthetic voice upon uttering text to be output as synthetic voice initially expresses a happy tone with a large volume, and then changes to express an angry tone, while the volume changes to be smaller than the initial volume.

Since other arrangements are the same as those in the first embodiment, a repetitive description will be omitted.

According to this embodiment with the above arrangement, a feature of synthetic voice of a desired range of text to be output can be continuously and easily changed.

Third Embodiment

The third embodiment based on the voice synthesis apparatus according to the first embodiment mentioned above will be explained below. In the following description, a repetitive description of the same building components as those in the first embodiment will be omitted, and a characteristic feature of this embodiment will be mainly explained.

In the first and second embodiments described above, attribute information contained in the start tag "<morphing . . . >" describes an object whose feature of synthetic voice is to be continuously changed, and attribute values of the start and end points of the object. By contrast, in the third embodiment, the start tag "<morphing . . . >" describes labels of an object to be changed at the start and end points.

FIG. 8 shows an example of tags assigned to text in the third embodiment, and text itself bounded by tags is the same as that in the second embodiment shown in FIG. 7. In this embodiment, an object to be changed is an emotion (emotion). Hence, the start and end points describe labels "emotionstart" and "emotionend" of an object to be changed. Since the arrangement of a voice synthesis apparatus in the third embodiment is the same as that in the first embodiment, a repetitive description thereof will be omitted. A difference between the first and third embodiments will be described below.

As in the first embodiment, the text analysis module 105 analyzes the type, contents, and the like of input tagged text 103 on the basis of the format and header information of that text, thus acquiring information associated with them. The tag analysis module 105 determines the types of tags embedded in the text. The tag attribute analysis module 107 analyzes attributes and attribute values described in the tags. In this embodiment, only the start and end points are to be analyzed, and the tag attribute analysis module 107 examines objects of the start and end points. The voice synthesis module 109 makes interpolation on the basis of the attribute values obtained by the tag attribute analysis module 107, and generates synthetic voice corresponding to the contents of the text in accordance with a voice waveform obtained as a result of interpolation.

Since attribute information embedded in each tag has the same configuration as in the first embodiment, a repetitive description thereof will be omitted. The difference between the first and third embodiments is as follows. That is, upon describing an emotion (emotion) as an object whose feature of synthetic voice is to be continuously changed, an emotion at the start point (start), and an emotion at the end point (end), the start point is assigned a label "emotionstart" of the object to be changed, and the end point is assigned a label "emotionend" of the object to be changed. In this embodiment, since an exception process is partially different in correspondence with such change in tag format, this difference will be explained with reference to FIG. 9.

Figure 9:
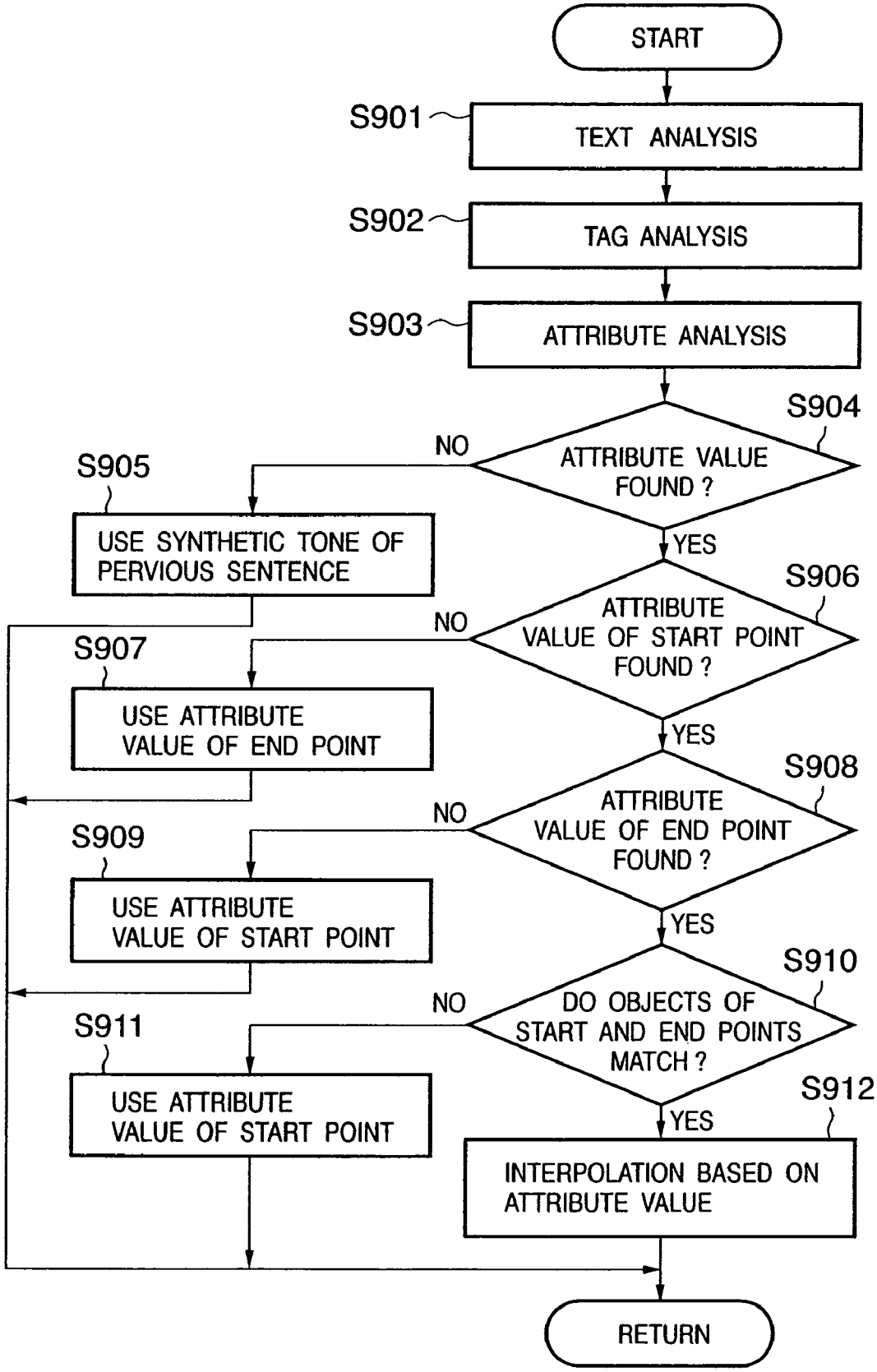
FIG. 9 is a flow chart showing the control process of a voice synthesis apparatus according to the third embodiment.

FIG. 9 is a flow chart showing the control process of the voice synthesis apparatus in the third embodiment, i.e., the sequence of processes to be executed by a CPU (not shown) of the apparatus.

Referring to FIG. 9, tagged text 103 input by the text input module 104 undergoes text analysis, tag analysis, and tag attribute analysis by the text analysis module 105, tag analysis module 106, and tag attribute analysis 107 (steps S901 to S903).

It is checked if the start tag "<morphing . . . >" includes start and end points. It is checked if either one of start and end points has an attribute (step S904). If neither of the start and end points have attribute values, text is read aloud according to voice which was read aloud in a sentence before that tag (step S905). It is then checked if the start point has an attribute value. If the start point does not have an attribute value, the attribute value of the end point is used (step S906, step S907). Conversely, if the start point has an attribute value but the end point does not have an attribute value, text is read aloud according to the attribute value of the start point (step S908, S909). If both the start and end points have attribute values, and they are not different, interpolation is made based on these attribute values, and synthetic voice is output (step S910, S912).

As the attribute values of the start and end points, if an object whose feature of synthetic voice is to be continuously changed is a volume, both the start and end points must assume volume values. If the types of attribute values of the start and end points are different (e.g., the start point has a volume value, and the end point has an emotion), the attribute value of the start point is used (step S911). When the tag has wrong attribute values, the priority of a voice output is (order of start point)>(order of end point).

Since other arrangements are the same as those in the first embodiment, a repetitive description thereof will be omitted.

According to this embodiment with the above arrangement, a feature of synthetic voice of a desired range of text to be output can be continuously and easily changed.

Fourth Embodiment

The fourth embodiment based on the voice synthesis apparatus according to the first embodiment mentioned above will be explained below. In the following description, a repetitive description of the same building components as those in the first embodiment will be omitted, and a characteristic feature of this embodiment will be mainly explained.

In the first to third embodiments, a change of morphing is constant, i.e., depends on the rate of change of the morphing algorithm itself. However, the fourth embodiment is characterized in that an attribute for a morphing change can also be added. FIG. 10 shows that example.

FIG. 10 shows an example of tags assigned to text in the fourth embodiment. In this embodiment, attribute information for the rate of change of morphing is also set in attributes in the start tag "<morphing . . . >". As an attribute value that expresses the rate of change of morphing, a type of function used in a change such as linear, non-linear, logarithm, or the like is set in "function".

In this embodiment, upon analyzing tags, the tag attribute analysis module 107 analyzes not only an object and start and end points, but also an attribute of a morphing change in accordance with an attribute value which represents the rate of change of morphing. As a result of analysis, if an attribute value such as linear, nonlinear, logarithm, or the like is described in a "function" field, interpolation is made in accordance with the rate of change given by that attribute value, and synthetic voice is output in accordance with a synthetic waveform obtained by interpolation. On the other hand, if this attribute value is not described, interpolation is made in accordance with a change method determined in advance by the morphing algorithm.

Since other arrangements are the same as those in the first embodiment, a repetitive description will be omitted.

According to this embodiment with the above arrangement, a feature of synthetic voice of a desired range of text to be output can be continuously and easily changed.

Fifth Embodiment

The fifth embodiment based on the voice synthesis apparatus according to the first embodiment mentioned above will be explained below. In the following description, a repetitive description of the same building components as those in the first embodiment will be omitted, and a characteristic feature of this embodiment will be mainly explained.

In the first to third embodiments, a change of morphing is constant, i.e., depends on the rate of change of the morphing algorithm itself. However, the fifth embodiment is characterized in that an attribute for a morphing change can be individually added in a tag. FIG. 11 shows that example.

FIG. 11 shows an example of tags assigned to text in the fifth embodiment. In this embodiment, intermediate tags for a morphing change are further inserted in text bounded by "<morphing . . . > . . . </morphing>" tags.

Figure 12:
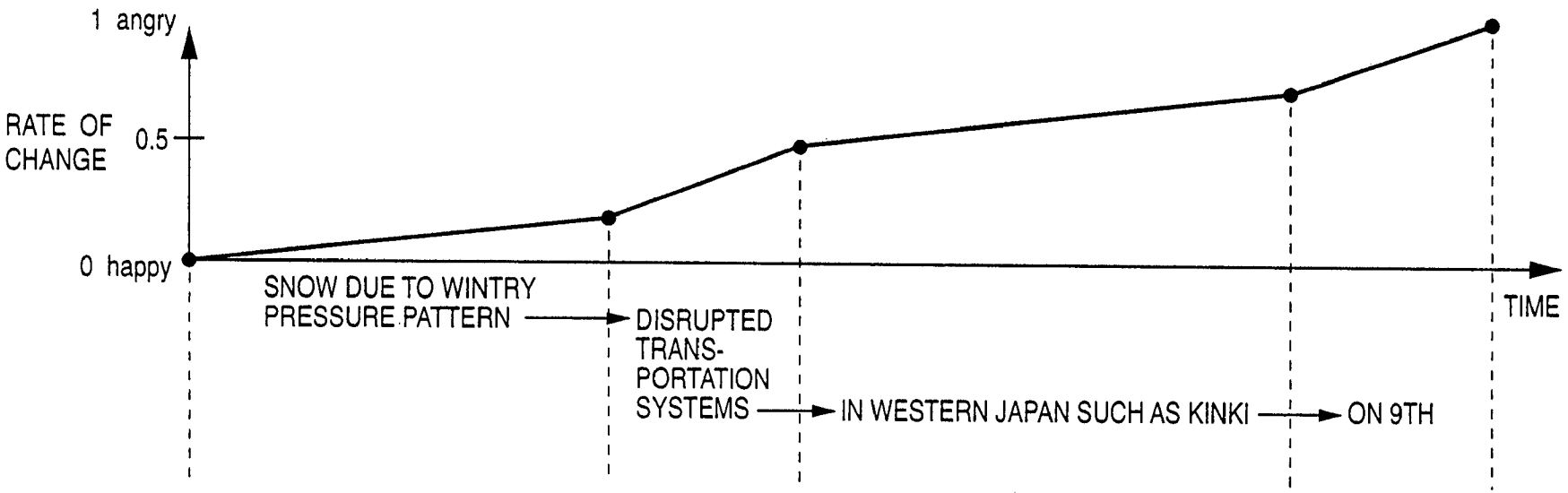
FIG. 12 is a graph for explaining a change in feature of synthetic voice upon outputting synthetic voice in the fifth embodiment.

In this embodiment, upon analyzing tags, the tag analysis module 106 analyzes not only "<morphing>" tags but also intermediate tags that generate morphing changes. The intermediate tag uses a tag like "<rate value="*.*"/>", and a rate of change ranging from 0 to 1 is described in a "value" attribute field. Then, such intermediate tags are individually embedded at desired positions in text whose feature of synthetic voice is to be continuously changed. In this way, upon actually outputting synthetic voice after interpolation, a further complex change in feature of synthetic voice can take place, as shown in FIG. 12.

It is noted that each of portion inserted the tag like "<rate value="*.*"/>" are, when translating from the original Japanese application to the present PCT application in English, arranged as shown in FIG. 11 because of difference of word order between Japanese and English. Accordingly, a line graph shown in FIG. 12 is also arranged, for obviously and appropriately explaining the present invention, in accordance with the arrangement of FIG. 11.

When a function "function" for a morphing change used in the fourth embodiment is also designated, a function designated earlier is used as an interpolation function from a given "<rate/>" tag to the next "<rate/>" tag.

Since other arrangements are the same as those in the first embodiment, a repetitive description will be omitted.

According to this embodiment with the above arrangement, a feature of synthetic voice of a desired range of text to be output can be continuously and easily changed.

Sixth Embodiment

The sixth embodiment based on the voice synthesis apparatus according to the first embodiment mentioned above will be explained below. In the following description, a repetitive description of the same building components as those in the first embodiment will be omitted, and a characteristic feature of this embodiment will be mainly explained.

In the aforementioned embodiments, the attribute values of the start and end points are set in the start tag "<morphing . . . >". However, in this embodiment, the attribute value of the end point is set in an end portion of the tag, as shown in FIG. 13.

FIG. 13 shows an example of tags assigned to text in the sixth embodiment.

In the tag configuration of the first embodiment, "<morphing type="emotion" start="happy">" is described as the attribute of the start point and object in the start tag "<morphing . . . >", and the attribute of the end point is described in the end tag like "</morphing end="angry">". By contrast, in this embodiment, "<morphing emotionstart="happy">" is described in the start tag, and "</morphing emotionend="angry">" is described in the end tag. When an interpolation function of the fourth embodiment is designated in this embodiment, it is described in the start tag.

Since other arrangements are the same as those in the first embodiment, a repetitive description will be omitted.

According to this embodiment with the above arrangement, a feature of synthetic voice of a desired range of text to be output can be continuously and easily changed.

Seventh Embodiment

The seventh embodiment based on the voice synthesis apparatus according to the first embodiment mentioned above will be explained below. In the following description, a repetitive description of the same building components as those in the first embodiment will be omitted, and a characteristic feature of this embodiment will be mainly explained.

In this embodiment, if the attributes of the start and end points in the tag are different from each other, an error is determined to inhibit the subsequent processes unlike in the above embodiments.

The tag configuration of the first embodiment will be taken as an example. That is, if attributes of "start" and "end" are different from each other like "<morphing type="emotion" start="happy" end="10">", an error is determined and no process is done. If neither of the start and end points have attributes or if either of them does not have an attribute, the same processes as in the first embodiment are executed. In the third embodiment, if neither of the start and end points have attributes or if either of them does not have an attribute, the same processes as in the third embodiment are executed. Since other arrangements are the same as those in the first to fifth embodiments, a repetitive description thereof will be omitted.

According to this embodiment with the above arrangement, a feature of synthetic voice of a desired range of text to be output can be continuously and easily changed.

Eighth Embodiment

The eighth embodiment based on the voice synthesis apparatus according to the first embodiment mentioned above will be explained below. In the following description, a repetitive description of the same building components as those in the first embodiment will be omitted, and a characteristic feature of this embodiment will be mainly explained.

In the aforementioned embodiments, even when at least one of a plurality of pieces of attribute information to be set in the tag is not found, synthetic voice is output. However, in this embodiment, when the attributes of the start and end points are different from each other, and when the attributes of the start and end points are different from that of an object, an error is determined, and no process is done.

Since other arrangements are the same as those in the first to seventh embodiments, a repetitive description thereof will be omitted.

According to this embodiment with the above arrangement, a feature of synthetic voice of a desired range of text to be output can be continuously and easily changed.

Therefore, according to the aforementioned embodiments, by bounding a desired range of input text to be output by tags, a feature of synthetic voice can be continuously changed like in morphing upon outputting synthetic voice, and a natural text-to-voice function for a listener can be implemented unlike in the prior art that produces discrete voice.

Another Embodiment

The preferred embodiments of the present invention have been explained, and the present invention may be applied to either a system constituted by a plurality of devices, or an apparatus consisting of a single equipment.

Note that the present invention includes a case wherein the invention is achieved by directly or remotely supplying a software program that implements the functions of the aforementioned embodiments to a system or apparatus, and reading out and executing the supplied program code by a computer of that system or apparatus. In this case, the form is not limited to a program as long as it has functions of the program.

Therefore, the program code itself installed in a computer to implement the functional process of the present invention using the computer implements the present invention. That is, the claims of the present invention include the computer program itself for implementing the functional process of the present invention.

In this case, the form of program is not particularly limited, and an object code, a program to be executed by an interpreter, script data to be supplied to an OS, and the like may be used as along as they have the program function.

As a recording medium for supplying the program, for example, a floppy disk, hard disk, optical disk, magnetooptical disk, MO, CD-ROM, CD-R, CD-RW, magnetic tape, nonvolatile memory card, ROM, DVD (DVD-ROM, DVD-R) and the like may be used.

As another program supply method, the program may be supplied by establishing connection to a home page on the Internet using a browser on a client computer, and downloading the computer program itself of the present invention or a compressed file containing an automatic installation function from the home page onto a recording medium such as a hard disk or the like. Also, the program code that forms the program of the present invention may be segmented into a plurality of files, which may be downloaded from different home pages. That is, the claims of the present invention include a WWW (World Wide Web) server which makes a plurality of users download a program file required to implement the functional process of the present invention by the computer.

Also, a storage medium such as a CD-ROM or the like, which stores the encrypted program of the present invention, may be delivered to the user, the user who has cleared a predetermined condition may be allowed to download key information that is used to decrypt the program from a home page via the Internet, and the encrypted program may be executed using that key information to be installed on a computer, thus implementing the present invention.

The functions of the aforementioned embodiments may be implemented not only by executing the readout program code by the computer but also by some or all of actual processing operations executed by an OS or the like running on the computer on the basis of an instruction of that program.

Furthermore, the functions of the aforementioned embodiments may be implemented by some or all of actual processes executed by a CPU or the like arranged in a function extension board or a function extension unit, which is inserted in or connected to the computer, after the program read out from the recording medium is written in a memory of the extension board or unit.

As described above, according to the above embodiments, a feature of synthetic voice of a desired range of text to be output can be continuously and easily changed.

As many apparently widely different embodiments of the present invention can be made without departing from the spirit and scope thereof, it is to be understood that the invention is not limited to the specific embodiments thereof except as defined in the claims.

The invention claimed is:

1. A voice synthesis method for synthesizing a voice waveform to continuously change a feature of synthetic voice of a range assigned a predetermined identifier included in input text upon outputting synthetic voice corresponding to the text, the method comprising:

a setting step, via a setting module, of setting a desired range of text to be output, in which the feature of synthetic voice is to be continuously changed, using a predetermined identifier including attribute information that represents a change mode of the feature of synthetic voice both at a start position and at an end position of the range set by the identifier;

a recognition step of recognizing the predetermined identifier and a type of attribute information contained in the predetermined identifier from the text with the identifier, which is set in said setting step; and a voice synthesis step of synthesizing a voice waveform, whose feature of synthetic voice continuously changes, in accordance with the attribute information contained in the predetermined identifier, by interpolating synthetic voice corresponding to text within the desired range of the text with the identifier in accordance with a recognition result in said recognition step, wherein the change mode of the feature of synthetic voice includes at least one of a change in output device, a change in a number of speakers and a change in emotion.

2. A voice synthesis apparatus for synthesizing a voice waveform to continuously change a feature of synthetic voice of a range assigned a predetermined identifier included in input text upon outputting synthetic voice corresponding to the text, the apparatus comprising:

recognition means for recognizing, from text with an identifier, in which a predetermined identifier that represents a desired range, in which the feature of synthetic voice is to be continuously changed, and which contains attribute information representing a change mode of the feature of synthetic voice both at a start position and at an end position of the range set by the identifier, the predetermined identifier and a type of attribute information contained in the predetermined identifier from the text with the identifier; and voice synthesis means for synthesizing a voice waveform, whose feature of synthetic voice continuously changes, in accordance with the attribute information contained in the predetermined identifier, by interpolating synthetic voice corresponding to text within the desired range of the text with the identifier in accordance with a recognition result of said recognition means, wherein the change mode of the feature of synthetic voice includes at least one of a change in output device, a change in a number of speakers and a change in emotion.

3. A computer-readable storage medium storing a computer program comprising program code for implementing the voice synthesis method according to claim 1.

4. A computer-readable storage medium storing a computer program comprising program code for causing a computer to serve as a voice synthesis apparatus for synthesizing a voice waveform to change a feature of synthetic voice of a range assigned a predetermined identifier included in input text upon outputting synthetic voice corresponding to the text, the program code comprising:

program code for a recognition function of recognizing, from text with an identifier, in which a predetermined identifier that represents a desired range, in which the feature of synthetic voice is to be continuously changed, and which contains attribute information representing a change mode of the feature of synthetic voice both at a start position and at an end position of the range set by the identifier, the predetermined identifier and a type of attribute information contained in the predetermined identifier from the text with the identifier; and program code for a voice synthesis function of synthesizing a voice waveform, whose feature of synthetic voice continuously changes, in accordance with the attribute information contained in the predetermined identifier, by interpolating synthetic voice corresponding to text within the desired range of the text with the identifier in accordance with a recognition result of the recognition function, wherein the change mode of the feature of synthetic voice includes at least one of a change in output device, a change in a number of speakers and a change in emotion.

* * * * *